US008651115B2

(12) United States Patent
Krauss

(10) Patent No.: US 8,651,115 B2
(45) **Date of Patent: *Feb. 18, 2014**

(54) COMBINATION TREATMENT OF TOBACCO EXTRACT USING ANTIOXIDANTS AND ANTIOXIDANT SCAVENGERS

(71) Applicant: Philip Morris USA Inc., Richmond, VA (US)

(72) Inventor: Marc Robert Krauss, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/751,878

(22) Filed: Jan. 28, 2013

(65) Prior Publication Data

US 2013/0133674 A1 May 30, 2013

Related U.S. Application Data

(63) Continuation of application No. 12/576,973, filed on Oct. 9, 2009, now Pat. No. 8,360,072.

(51) Int. Cl.
*A24B 15/24* (2006.01)

(52) U.S. Cl.
USPC ..... 131/297; 131/360; 131/352; 131/309; 131/290

(58) Field of Classification Search
None
See application file for complete search history.

(56) References Cited

U.S. PATENT DOCUMENTS

| | | | | |
|---|---|---|---|---|
| 4,516,588 | A | 5/1985 | Rudolph et al. | |
| 4,655,231 | A | 4/1987 | Ray et al. | |
| 4,966,171 | A | 10/1990 | Serrano et al. | |
| 5,499,636 | A | 3/1996 | Baggett, Jr. et al. | |
| 5,601,097 | A | 2/1997 | De Grandpre et al. | |
| 5,666,976 | A | 9/1997 | Adams et al. | |
| 5,692,525 | A | 12/1997 | Counts et al. | |
| 5,692,526 | A | 12/1997 | Adams et al. | |
| 5,810,020 | A | 9/1998 | Northway et al. | |
| 5,915,387 | A | 6/1999 | Baggett, Jr. et al. | |
| 5,944,026 | A | 8/1999 | Kopsch et al. | |
| 5,988,176 | A | 11/1999 | Baggett, Jr. et al. | |
| 6,026,820 | A | 2/2000 | Baggett, Jr. et al. | |
| 6,298,859 | B1 * | 10/2001 | Kierulff et al. | 131/297 |
| 6,576,275 | B1 | 6/2003 | Hoving et al. | |
| 6,772,767 | B2 * | 8/2004 | Mua et al. | 131/297 |
| 7,294,353 | B2 | 11/2007 | Gow et al. | |
| 7,581,543 | B2 | 9/2009 | McGrath et al. | |
| 8,353,300 | B2 | 1/2013 | Li et al. | |
| 8,360,072 | B2 | 1/2013 | Krauss | |
| 2005/0241657 | A1 | 11/2005 | Mua et al. | |

FOREIGN PATENT DOCUMENTS

| | | | |
|---|---|---|---|
| WO | WO 03/022081 | A1 | 3/2003 |
| WO | WO 2005/099493 | A2 | 10/2005 |

OTHER PUBLICATIONS

Rundlof et al. J. Agric. Food Chem. 200, 48, 43814388.*
International Search Report and Written Opinion dated Mar. 2, 2011 for PCT/EP2010/006099.
International Preliminary Report on Patentability dated Apr. 11, 2012 for PCT/EP2010/006099.
Li et al., Wounding of Root or Basal Stalk Prior to Harvest Affects Pre-harvest Antioxidant Accumulation and Tobacco-specific Nitrosamine Formation during Air Curing of Burley Tobacco (*Nicotiana tabacum* L.), *J. Agronomy & Crop Science*, 2006, pp. 267-277, vol. 192, Blackwell Verlag, Berlin.
Panzella et al., "Acid-Promoted Reaction of the Stilbene Antioxidant Resveratrol with Nitrite Ions: Milk Phenolic Oxidation at the 4'-Hydroxystiryl Sector Triggering Nitration, Dimerization, and Aldehyde-Forming Routes," *J. Org. Chem.*, 2006, pp. 4246-4254, vol. 71 (11), American Chemical Society.
Rundlof et al., "Potential Nitrite Scavengers as Inhibitors of the Formation of N-Nitrosamine in Solution and Tobacco Matrix Systems", 2000, J. Agric. Food, vol. 48, pp. 4381-4388.

* cited by examiner

*Primary Examiner* — Richard Crispino
*Assistant Examiner* — Phu Nguyen
(74) *Attorney, Agent, or Firm* — Buchanan Ingersoll & Rooney PC

(57) ABSTRACT

A process for treating a tobacco material comprising: (a) extracting a tobacco material with a solvent to produce a tobacco extract and a tobacco residue; (b) contacting the tobacco extract with an antioxidant; and (c) contacting the mixture of (b) with an antioxidant scavenger, to produce a treated tobacco extract. The treated tobacco extract is reapplied to the tobacco residue to form a treated tobacco material. In addition, a smoking composition, a smoking article and a smokeless tobacco oral delivery product contain the treated tobacco material.

17 Claims, No Drawings

COMBINATION TREATMENT OF TOBACCO EXTRACT USING ANTIOXIDANTS AND ANTIOXIDANT SCAVENGERS

BACKGROUND

Nitrosamines and in particular, tobacco specific nitrosamines (TSNAs) are targeted constituents of tobacco smoke. In addition, certain polyphenol compounds can form undesirable phenolic compounds during the combustion of tobacco and may also be targeted constituents of tobacco smoke. There is interest in providing a method for reducing the contents of these targeted compounds in tobacco smoke.

SUMMARY

The present application describes a process for treating a tobacco material comprising:

(a) extracting a tobacco material with a solvent to produce a tobacco extract and a tobacco residue, wherein the tobacco extract comprises at least one nitrite compound;

(b) contacting the tobacco extract with an antioxidant, to produce a mixture having a reduced content of the at least one nitrite compound; and (c) contacting the mixture with an antioxidant scavenger, thereby removing the antioxidant therein, to produce a treated tobacco extract.

DETAILED DESCRIPTION OF THE PREFERRED EMBODIMENTS

As used herein, "tobacco material" denotes a tobacco starting material to be treated in various processes described herein, regardless of type, source or origin, which may have previously been subjected to other treatments. The tobacco material may include, but is not limited to, tobacco solids and any solid form of tobacco, such as, e.g., cured tobacco (such as flue-cured tobacco); uncured tobacco (also known as green tobacco); dried, aged, cut, ground, stripped or shredded tobacco; tobacco scrap; expanded tobacco, fermented tobacco; reconstituted tobacco, tobacco blends, etc. The tobacco material may be from any parts of the tobacco plant, such as leaf, stem, veins, scrap and waste tobacco, cuttings, etc.

Fresh-cut, green tobacco may contain very low levels of nitrosamine compounds. Yet, bulk nitrosamines including a variety of TSNAs can be formed during the post-harvest treatments, i.e., curing and ageing of tobacco. In addition, the concentrations of nitrosamines and TSNAs in tobacco may also increase during the processing, storage and burning of tobacco. These TSNAs may include N-nitrosonornicotine (NNN), 4-(methylnitrosamino)-1-(3-pyridyl)-1-butanone, 4-(methylnitrosamino)-1-(3-pyridyl)-1-butanol, N-nitrosoanatabine (NAT), N-nitrosoanabasine (NAB), 4-methyl-N-nitrosamino-1-(3-pyridyl)-1-butanone (NNK), 4-(methylnitrosamino)-4-(3-pyridyl)butanal, 4-(methylnitrosamino)-4-(3-pyridyl)-1-butanol (NNA), and 4-(methylnitrosamino)-4-(3-pyridyl)butyric acid.

It is believed that the formation of the nitrosamines and TSNAs in tobacco material are attributable to nitrite, which can be formed by the bacterial reduction of nitrate. Nitrite may generate reactive nitrosating species, such as $N_2O_3$ or $N_2O_4$, which, in turn, can react with secondary amines including tobacco alkaloids, such as nicotine, nornicotine, anabasine and anatabine, e.g., under acidic conditions, forming nitrosamines including TSNAs. In the reaction, an NO group is added to the nitrogen atom of the secondary amines.

As described herein, the soluble nitrite in tobacco material can be reduced and thus is no longer available to participate in nitrosation reactions by treatment with an antioxidant. The actual product of the reaction between the nitrite and antioxidant may depend on the pH of the reaction medium. By reducing the amount of nitrite available in the tobacco material, nitrosation of the secondary amines including tobacco alkaloids, can be effectively limited, thereby lowering the concentrations of the TSNA's in the tobacco material.

The chemical composition of tobacco material can be modified by manipulating the extract of the tobacco material. A variety of solvents can be used to obtain such tobacco extracts, depending on the tobacco constituents that are being manipulated. As described herein, a suitable extracting solvent should generally be capable of dissolving most, if not all, of the nitrite in or on the tobacco material. In this embodiment, at least some of the nitrite can be extracted from the tobacco material into the solvent during extraction. Generally, polar protic solvents, such as water, methanol, ethanol, ethylene glycol and the like, can dissolve nitrite and thus can be used as extracting solvents. These solvents may be used individually or in combination thereof. Preferably, the extracting solvent contains water. Extraction may be conducted at room temperature (about 73° F.) or an elevated temperature, e. g., up to about 160° F., to further increase the solubility of the nitrite in the extracting solvent.

Additionally, the extracting solvent may include additional components, such as acetone, ether or other solvents, as well as other solutes, to further improve the extractability of the nitrite from the tobacco material.

As described herein, the tobacco material can be extracted to result in a mixture comprising a tobacco extract and a solid tobacco residue, which can then be contacted with an antioxidant. Preferably, the tobacco extract can be separated from the solid tobacco residue prior to the antioxidant treatment. Any suitable separation procedure can be used, including but not limited to, decanting, filtration, ultrafiltration, reverse osmosis, sedimentation, centrifugation, and combinations thereof.

"Antioxidants" are compounds which halt or slow chemical oxidation, such as that caused by free radicals, by chemical reduction of reactive free radicals.

Antioxidants are often organized into groups, depending on their chemical structures. These groups may include carotenoid terpenoids; flavonoid polyphenolics (bioflavanoids); phenolic acids and phenolic acid esters; nonflavanoid phenolics; and other organic antioxidants. The carotenoid terpenoids may include, but are not limited to, lycopene, lutein, alpha-carotene, beta-carotene, zeaxanthin and astaxanthin. Flavanoid polyphenolics or bioflavanoids may include, but are not limited to, flavanols, such as resveratrol, kaempferol, myricetin, isorhamnetin and proanthocyanadins; the flavones, such as quercetin, rutin, luteolin, apigenin and tangeritin; the flavanones, such as hesperetin, naringenin and eriodictyol; the flavan-3-ols, such as catechin, gallocatechin, epicatechin, epigallocatechin, theaflavin and thearubigin; the isoflavone phytoestrogens, such as genistein, diadzein and glycitein; and the anthocyanins, such as cyanidin, delphinidin, malvidin, pelargonidin, peonidin and petunidin. The phenolic acids and phenolic acid esters include, but are not limited to, ellagic acid, gallic acid, salicylic acid, rosmarinic acid, chlorogenic acid, chicoric acid, the gallotannins and the ellagitannins. Nonflavanoid phenolic compounds include, but are not limited to, curcumin. Other organic antioxidants may include citric acid, lignan and eugenol. Some of the well-known biological antioxidants are vitamins A (retinol), C (ascorbic acid), and E (including tocotrienol and tocopherol). Many of these antioxidants can react with soluble nitrite in tobacco extracts.

In one embodiment, the antioxidant can include polyphenolic antioxidants, such as chlorogenic acid, gallic acid, and/or flavanoids. Preferably, the antioxidant contains one or more polyphenolic antioxidants endogenous to tobacco, such as chlorogenic acid. The amount of antioxidant used may vary depending on the type and conditions of the tobacco starting material to be treated. Typically, the antioxidant can be used in an amount which is sufficient to at least substantially remove the nitrite from the tobacco extract. Preferably, the antioxidant can be added to completely remove the nitrite from the tobacco extract. The antioxidant may be employed either in its pure form or as a solution in an appropriate solvent. Further, the antioxidant treatment of the tobacco extract is preferably conducted at room temperature.

A "polyphenol" or "polyphenolic," as used herein, denotes a compound having more than one phenolic hydroxyl group in the molecule, and may include compounds with multiple hydroxyl group-bearing phenyl rings, such as flavonoids, as well as compounds with a single phenyl ring and multiple hydroxyl groups on that ring, such as chlorogenic acid and gallic acid.

Various polyphenolic compounds contained in tobacco material can lead to the formation of undesirable phenolic compounds during the combustion of tobacco, such as phenol, resorcinol, hydroquinones (e.g., hydroquinone, methyl hydroquinone and 2,3-dimethyl hydroquinone), catechols (e.g., catechol, 3-methylcatechol, 4-methylcatechol, dimethylcatechol and ethyl catechol) and cresols (e.g., o-cresol, m-cresol and p-cresol). In particular, when an extract of tobacco material is treated with a polyphenolic antioxidant, such as chlorogenic acid, and reapplied to obtain a reconstituted tobacco material, the resulting tobacco material may contain a higher concentration of polyphenolic compounds, which include un-consumed antioxidant employed and the polyphenolic compounds contained in the tobacco starting material. The concentrations of these phenolic compounds in mainstream smoke can be reduced by reducing the concentration of phenolic compound precursors, including polyphenolic compounds, in an antioxidant-treated tobacco material.

As described herein, these polyphenolic compounds may be removed from tobacco extracts using an antioxidant scavenger. The term "antioxidant scavenger," as used herein, denotes a compound which sequesters an antioxidant, in particular, the antioxidant described herein, either by associating with the antioxidant directly or aiding in the association of an antioxidant with one or more other compounds. The terms "associating" and "association," as used herein, denote chemical and/or electrostatic interactions, e.g., chemical reactions, complex formation, etc. Preferably, the antioxidant scavenger contains a polyphenol scavenger, which is capable of adsorbing, reacting or otherwise removing polyphenols and polyphenolic compounds from a composition.

In an embodiment, polyphenols and polyphenolic compounds, including polyphenolic antioxidants, can be adsorbed, and thus removed from a solution, by a variety of polymers. Preferably, insoluble polymeric compounds, such as polyvinylimidizole (PVI), polyvinylpyrrolidone (PVP), polyvinylpolypyrrolidone (PVPP), poly(vinylimidizole-co-vinylpyrrolidone) (PVP/PVI) copolymer, and the like can be used as the antioxidant scavenger. Enzymes are not required in this process. These polymers can be used individually or in combination thereof. Commonly owned copending Application No. 2005/0279374 describes reduction of phenolic compound precursors in tobacco by treatment with PVPP or PVI in the absence of an enzyme. Such polymers can readily be prepared to have sufficiently high molecular weight and/or sufficient cross-linking so that they are substantially insoluble in solutions, in particular, an aqueous solution. Commercially available polymers suitable for use include DIVERGAN® RS, a PVPP polymer, and DIVERGAN® HM, a PVP/PVI copolymer (DIVERGAN® is a registered trademark of BASF Aktiengesellschaft).

These insoluble polyphenolic compounds-adsorbing polymers can be used as the antioxidant scavenger described herein, to remove polyphenolic compounds from antioxidant-treated tobacco extracts.

As described herein, the tobacco extract after the antioxidant treatment may contain one or more polyphenolic compounds, which are present in the original tobacco extract and/or introduced as an antioxidant during the antioxidant treatment. To remove these polyphenolic compounds, the antioxidant treated tobacco extract may be contacted with the antioxidant scavenger by one of various methods. For example, an insoluble solid antioxidant scavenger may be added to the tobacco extract, and allowed to adsorb polyphenolic compounds in the tobacco extract. In an embodiment, an antioxidant scavenger may be applied to a tobacco extract at room temperature. Once the polyphenolic compounds have substantially been adsorbed, the polyphenolic compound-adsorbed antioxidant scavenger may be separated from the extract by any suitable method which does not cause desorption of the adsorbed polyphenolic compounds from the antioxidant scavenger. Examples of suitable separation methods include, but are not limited to, filtration, ultrafiltration, sedimentation, reverse osmosis, centrifugation, decantation, and any combinations thereof.

The amount of antioxidant scavenger may vary depending on the amount and type of antioxidant used, and type and conditions of the tobacco material to be treated. Typically, an antioxidant scavenger can be used in an amount sufficient to at least substantially remove the antioxidant in the mixture. Preferably, the antioxidant scavenger can be added to completely remove the antioxidant in the tobacco extract. Further, the antioxidant scavenger treatment of the tobacco extract is preferably conducted at room temperature.

In one embodiment, the antioxidant scavenger is supplied in a form which can be easily separated from a solution after use. For example, the antioxidant scavenger may be included in a porous container or attached to the surface of a solid object, which can be easily recovered from a solution to be treated. In addition, the antioxidant scavenger may be applied onto a membrane, e.g., a filtering membrane, through which a solution to be treated can be made to pass. Further, the antioxidant scavenger may be attached to the surface of a solid or fluidized bed, by which a solution to be treated can be made to pass. The attachment of the antioxidant scavenger to a solid object or a bed may be carried out in any suitable method, depending on the solid and antioxidant scavenger materials used. With these configurations, after treatment with the antioxidant scavenger, the treated solution is no longer in contact with the antioxidant scavenger. Therefore, there is no need for further separation of a mixture containing the treated tobacco extract (liquid phase) and antioxidant-adsorbed antioxidant scavenger (solid phase), thereby improving the production efficiency as well as reducing the production costs.

In another embodiment, the antioxidant scavenger is also capable of adsorbing, thereby removing, one or more metals from a tobacco extract, in addition to removing the polyphenolic compounds therein. For example, polyvinylimidizole (PVI) and PVP/PVI copolymer can bind to various metals, such as cadmium, nickel, iron, copper, aluminum and the like, allowing for their removal from a tobacco extract at the same time.

Subsequent to treatment with an antioxidant and an antioxidant scavenger as described herein, the tobacco extract can be optionally concentrated to a desired volume by removing a portion of the solvent therein, and then reapplied to the solid tobacco residue obtained from extraction, to form a reconstituted tobacco material. The resulting reconstituted tobacco material can have reduced amounts of nitrosamine compounds, phenols and phenolic compounds, and/or metals, may then be used to prepare a smoking composition for smoking articles or a smokeless composition for smokeless tobacco oral delivery products.

As used herein, the term "smoking article" is intended to include cigarettes, cigars, pipes and the like. In particular, the smoking article can be a traditional or non-traditional lit-end cigarette comprising a tobacco rod and a filter attached thereto. Non-traditional cigarettes include, but are not limited to, cigarettes for electrical smoking systems as described in commonly-assigned U.S. Pat. Nos. 6,026,820; 5,988,176; 5,915,387; 5,692,526; 5,692,525; 5,666,976; and 5,499,636. Other non-traditional cigarettes include those having a fuel element in the tobacco rod as described in U.S. Pat. No. 4,966,171.

In one embodiment, the smoking article is a cigarette.

Preferably, smokeless tobacco oral delivery products, such as chewing tobacco or pouched tobacco, are sized to comfortably be received in a human mouth. In addition, the oral products may be sized so that it can be moved around inside a human mouth, while not materially interfering with speech or oral breathing.

A pouched tobacco typically contains an external wrapper and a tobacco material therein. The external wrapper preferably comprises a membrane that is sufficiently porous to allow passage through the membrane of a liquid, such as saliva, in the mouth. The external wrapper membrane is preferably resistant to deterioration in the presence of saliva and bacteria, and may be constructed from cellulose fiber such as tea bag material.

The embodiments disclosed herein are further illustrated by the following specific examples but is not limited hereto.

EXAMPLES

Example I

Nitrite Reduction in Tobacco Extract Using Chlorogenic Acid

Tobacco (0.5 g) is extracted with deionized water (10 mL) for one hour at room temperature. The solid tobacco material is removed from contact with the aqueous solution, and chlorogenic acid (0.25 g) is added to the solution. The solution is stirred for two hours at room temperature. Nitrite concentrations are determined both before and after treatment with chlorogenic acid. Nitrite concentrations are found to decrease after the addition of chlorogenic acid.

Example II

Nitrosamine and TSNA Reduction in Tobacco Using Combination of Antioxidant Addition and Subsequent Treatment with PVI Tobacco (0.5 g) and chlorogenic acid (100 mg) are combined with deionized water (10 mL) and stirred for one hour. The solids are removed from the extract, PVI (solid particles, 2.0 g) are added and the resultant mixture is stirred for one hour. The mixture is centrifuged and filtered through a 0.45 μm filter. The filtrate is concentrated and reapplied to the extracted tobacco, which is then processed into a cigarette. The cigarette is analyzed. The concentration of TSNA's, polyphenols, cadmium, nickel, iron, copper and aluminum in the cigarette are all lower than the concentrations in a cigarette made from untreated tobacco.

While the foregoing has been described in detail with reference to specific embodiments thereof, it will be apparent to one skilled in the art that various changes and modifications may be made, and equivalents thereof employed, without departing from the scope of the claims.

All of the above-mentioned references are herein incorporated by reference in their entirety to the same extent as if each individual reference was specifically and individually indicated to be incorporated herein by reference in its entirety.

The invention claimed is:

1. A process for treating a tobacco material comprising:

(a) extracting a tobacco material with a solvent to produce a tobacco extract and a tobacco residue, wherein the tobacco extract comprises at least one nitrite compound;

(b) contacting the tobacco extract with an antioxidant, to produce a mixture having a reduced content of the at least one nitrite compound; and (c) contacting the mixture with an antioxidant scavenger, thereby removing the antioxidant therein to produce a treated tobacco extract, wherein the antioxidant comprises chlorogenic acid.

2. The process of claim 1, further comprising separating the antioxidant scavenger from the mixture in the contacting (c).

3. The process of claim 2, wherein the separating is carried out by centrifugation, filtration, ultrafiltration, sedimentation, reverse osmosis, adsorption, decantation, or any combinations thereof.

4. The process of claim 1, further comprising applying the treated tobacco extract to the tobacco residue, following the contacting (c).

5. A tobacco material treated by the process of claim 4.

6. A smoking composition comprising a tobacco material treated by the process of claim 4.

7. A smoking article comprising a rod of tobacco material treated by the process of claim 4.

8. A smokeless tobacco material treated by the process of claim 4.

9. The smokeless tobacco material of claim 8, wherein the smokeless tobacco material is contained in a pouch comprising a porous material.

10. The process of claim 1, further comprising removing a portion of the solvent in the treated tobacco extract, following the contacting (c).

11. The process of claim 1, further comprising separating the tobacco residue from the tobacco extract, following the extracting (a) and prior to the contacting (b).

12. The process of claim 1, wherein the extracting (a) is carried out at a temperature ranging from room temperature to about 160° F.

13. The process of claim 1, wherein the solvent comprises at least one selected from the group consisting of water, methanol, ethanol and ethylene glycol.

14. The process of claim 13, wherein the solvent further comprises at least one of acetone and ether.

15. The process of claim 1, wherein the antioxidant scavenger is insoluble in the tobacco extract.

16. The process of claim 1, wherein the antioxidant scavenger comprises a polymer selected from the group consisting of polyvinylimidizole (PVI), polyvinylpyrrolidone (PVP), polyvinylpolypyrrolidone (PVPP), poly(vinylimidizole-co-vinylpyrrolidone) (PVI/PVP copolymer) and combinations thereof.

17. The process of claim 1, wherein the antioxidant scavenger is capable of removing at least one metal selected from the group consisting of cadmium, nickel, iron, copper and aluminum from the tobacco extract.

* * * * *